US006581762B2

(12) United States Patent
Keough

(10) Patent No.: US 6,581,762 B2
(45) Date of Patent: Jun. 24, 2003

(54) PERSONAL OBJECT HOLDING DEVICE

(76) Inventor: Robert Keough, 214-16 42nd Ave., Bayside, NY (US) 11361

( * ) Notice: Subject to any disclaimer, the term of this patent is extended or adjusted under 35 U.S.C. 154(b) by 0 days.

(21) Appl. No.: 09/961,831

(22) Filed: Sep. 24, 2001

(65) Prior Publication Data

US 2003/0057112 A1 Mar. 27, 2003

(51) Int. Cl.[7] ..... A45C 11/32
(52) U.S. Cl. ..... 206/39.4; 206/449
(58) Field of Search ..... 206/39, 39.4, 39.5, 206/39.6, 308.1, 308.3, 425, 449; 150/147; 312/9.11, 9.16, 9.17, 9.27

(56) References Cited

U.S. PATENT DOCUMENTS

| | | | | |
|---|---|---|---|---|
| 638,676 | A | | 12/1899 | Winegarden |
| 1,350,886 | A | | 8/1920 | Scholz |
| 1,735,253 | A | | 11/1929 | Laine |
| 2,475,999 | A | | 7/1949 | Sparagano |
| 2,570,046 | A | * | 10/1951 | Burns ..... 312/9.27 |
| 2,640,347 | A | | 6/1953 | Majeski |
| 2,694,921 | A | | 11/1954 | Kerner |
| 4,301,917 | A | * | 11/1981 | Ancell ..... 206/39.5 |
| 4,674,628 | A | * | 6/1987 | Prinsloo et al. ..... 206/39 |
| 4,697,698 | A | * | 10/1987 | Holdener ..... 206/39.4 |
| 4,852,727 | A | | 8/1989 | Oberle |
| 5,215,190 | A | | 6/1993 | Hoffpauir, Jr. |
| 5,960,944 | A | | 10/1999 | Plocher |
| 6,089,289 | A | * | 7/2000 | Florjancic ..... 206/39.6 |
| 6,412,627 | B1 | | 7/2002 | Tiscione et al. |

* cited by examiner

*Primary Examiner*—Luan K. Bui
(74) *Attorney, Agent, or Firm*—Hoffmann & Baron, LLP

(57) ABSTRACT

The present invention is a personal object holding device having an outer housing device having several separating walls inside the housing to form card holding chambers. The card holding chambers are sized to accommodate objects approximating the size of object such as credit cards, identification cards, drivers licenses and bank cards. The object holding device has at least one biasing member positioned on one of the separating walls for each of the chambers to hold the objects positioned in the chambers firmly in place. The personal object holding device further includes an ejection mechanism positioned within the housing which is used to urge the object positioned in the chamber out when desired.

10 Claims, 7 Drawing Sheets

PERSONAL OBJECT HOLDING DEVICE

BACKGROUND OF THE INVENTION

The present invention relates to a compartmentalized holding device for retaining and ejecting objects approximating the size and shape of cards, e.g., credit cards, identification cards and business cards.

People typically carry many different types of objects with them in their daily lives. Such objects can include such items necessary in the modern world as identification cards, credit cards, business cards and various other flat objects which can be the same size as a typical business card or credit card. These credit cards and other objects are typically used by people throughout the world and have become necessary for people to use in order to go about their daily lives. Problems are associated with carrying a variety of different types of cards at a single time. People typically must carry eight to ten cards, e.g., credit card(s), bank card(s), identification card, security card, driver license, business card(s), electronic security card and other cards similar in size and that can be used on a common basis.

The cards are typically held in either a billfold or a wallet. However, a problem encountered when carrying the cards in billfolds or wallets is accommodating the cards plus additional items, such as paper money, change, spare keys, etc. The wallet or billfold can become very thick and bulky to use and/or be very disorganized and inconvenient to use.

Another problem with using typical wallets is that they are generally designed to carry only, at most, a few and not the 8 or 10 which are now required. The wallets, therefore, become very disorganized since the user overfills the wallet to hold as many cards as possible. This overfilling creates a wallet condition which is impractical since it is very difficult to find the appropriate item in a "messy,") "overstuffed" wallet!

Another disadvantage to the disorganized wallet condition is the exposure of the user to potential thieves since the user is in a state of confusion while looking for various items in his or her wallet.

There have been several designs for improved card carrying devices which have attempted to improve the design of a typical wallet to carry cards in a more organized fashion. U.S. Pat. Nos. 4,852,727 and 4,697,698 disclose card carrying devices having slidable draws housed inside an outer housing. The draws are actuated by the use of a button attached to the draws. The draws slidably move within the housing to present the card for the user to remove from the draw. However, one problem with the both of these designs is that when the card is presented with the draw outside the housing it is possible to easily damage the draw since it is very thin in nature and can be easily damaged by, for example, taking the card sloppily out of the slot.

It is, therefore, desirable to create a compartmentalized holding device for addressing these shortcomings and disadvantages associated with the devices of the prior art.

SUMMARY OF THE INVENTION

The present invention is a personal object holding device having an outer housing device having several separating walls inside the housing to form card holding chambers. The card holding chambers are preferably sized to accommodate objects which are the approximate size of a credit card. Other objects which are similarly sized to credit cards, such as identification cards, drivers license, bank cards, business cards, etc., can also be placed in the card holding chambers. Preferably, there is at least one biasing member positioned on one of the separating walls for each of the chambers. The biasing members need to create a biasing tension against the object positioned in the chamber so that the object is firmly held in place. The personal object holding device further includes an ejection mechanism positioned within the housing which is used to urge the object positioned in the chamber out of the chamber when desired.

In a preferred embodiment, the ejection mechanism has at least one push plate slidably positioned in each chamber. The push plate is positioned so that it is substantially coplanar with the object or card positioned within the chamber. The ejection mechanism can also have a push element which slidably moves within the housing and extends from the top surface of the housing to the bottom surface of the housing. The push element slides within a groove within the housing so that when the push element is slidably moved it contacts the push plate which in turn then pushes the object out of the chamber. In the preferred embodiment, the push element can have an actuation button attached to the push element on the exterior of the housing so that the user can easily locate the push element. Preferably, the push element is a rod shaped member. The push rod is positioned so that only one push rod corresponds to a specific push plate for a particular chamber. Therefore, actuating one push rod will only actuate a specific push plate to eject only one card.

The biasing member in a preferred embodiment can be a resilient piece of metal which is attached to the one of the separating walls of a chamber and extends toward an opposite wall of the chamber. Thus, when a card is placed within a chamber it is held against the opposite wall by the biasing member. The biasing member can also be integrally formed as part of a separating wall. It is envisioned that the biasing member can be integrally molded as part of the separating wall when used in a separating wall which can be formed by injection molding or casting.

In a preferred embodiment, the card holding device can have several chambers positioned above one another. Each chamber is positioned above one another with a corresponding push plate for each chamber and a separate push rod which corresponds to a particular push plate for each chamber. The push plates can include a series of notches which are used to selectively limit the movement of the push plate to a particular push rod. Preferably, each push plate will have several notches along its outer perimeter so that if a push rod for a different chamber is actuated, the push rod will occupy a notch in the push plate and will not move the push plate for the chamber which is not being used.

As a result of the present invention, it is an advantage to have a object holding device which selectively holds various objects approximating the size of cards.

It is an advantage of the present invention to provide a convenient object holding device which organizes various objects for a user in a convenient wallet like structure.

It is a further advantage of the present invention to provide an object holding device where the object can be selectively individually removable when needed by the user.

It is a still further advantage of the present invention to create a modular design which can be easily manufactured create multiple card holding chambers depending upon the users needs.

For a better understanding of the present invention, together with other and further advantages, reference is made to the following detailed description, taken in conjunction with the accompanying drawings, and the scope of the invention will be pointed out in the appended claims.

DETAILED DESCRIPTION OF THE INVENTION

Figure 1:
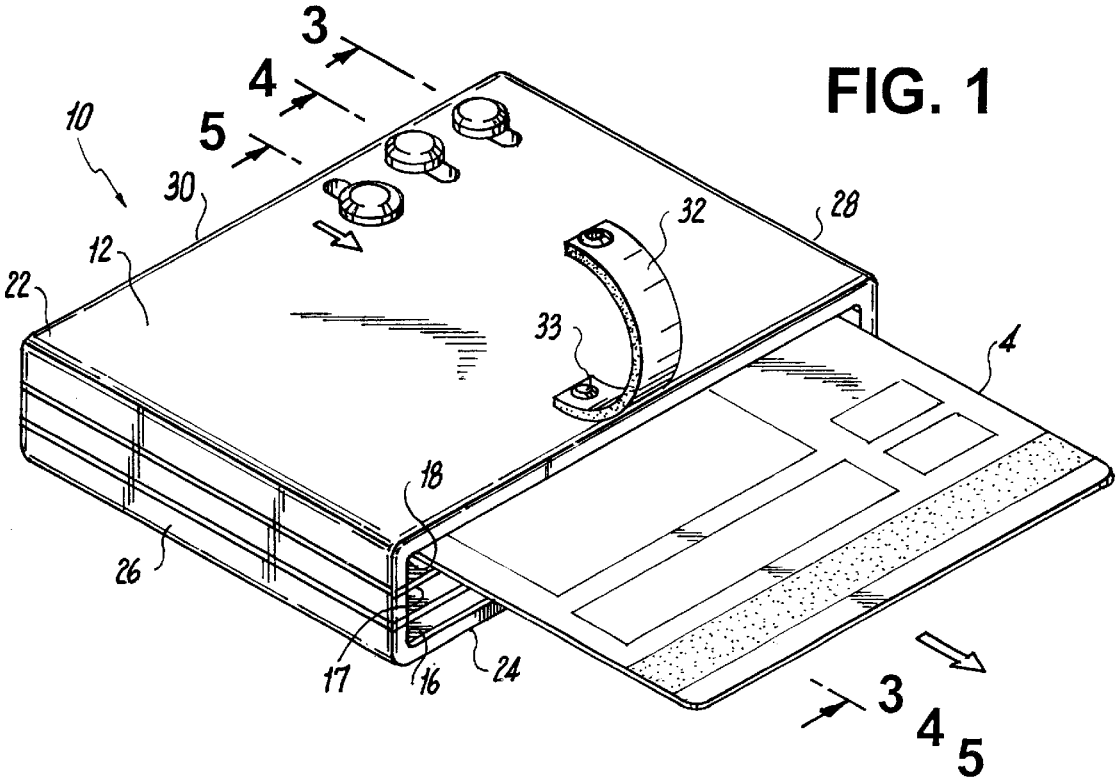
FIG. 1 is a perspective view of a preferred embodiment of the holding device of the present invention.

Referring to FIGS. 1–5 a personal object holding device 10 is shown having an outer housing 12 and separating walls 14 and 15 which form card holding chambers 16, 17 and 18. Card holding chambers 16, 17 and 18 are preferably sized to accommodate objects which are the approximate size of a credit card. Preferably, there is at least one biasing member 19 provided on the separating walls 14 and 15 to create a biasing tension against the object positioned in chambers 16, 17 and 18 and thereby hold it firmly in place. The object holding device 10 further includes an ejection mechanism 20 which is used to urge the object(s) out of chambers 16, 17 and 18 when desired.

As depicted herein, the outer housing 12 has a top wall 22 and a bottom wall 24 substantially parallel to the top wall 22, and side walls 26, 28 and 30 which form a substantially rectangular housing. In one embodiment, the outer housing 12 is made of a rigid material whereby its shape is maintained. In one embodiment, separating walls 14 and 15 are made of a semi rigid or rigid material so that an object such as a credit card is supported by separating walls 14 and 15.

Figure 2:
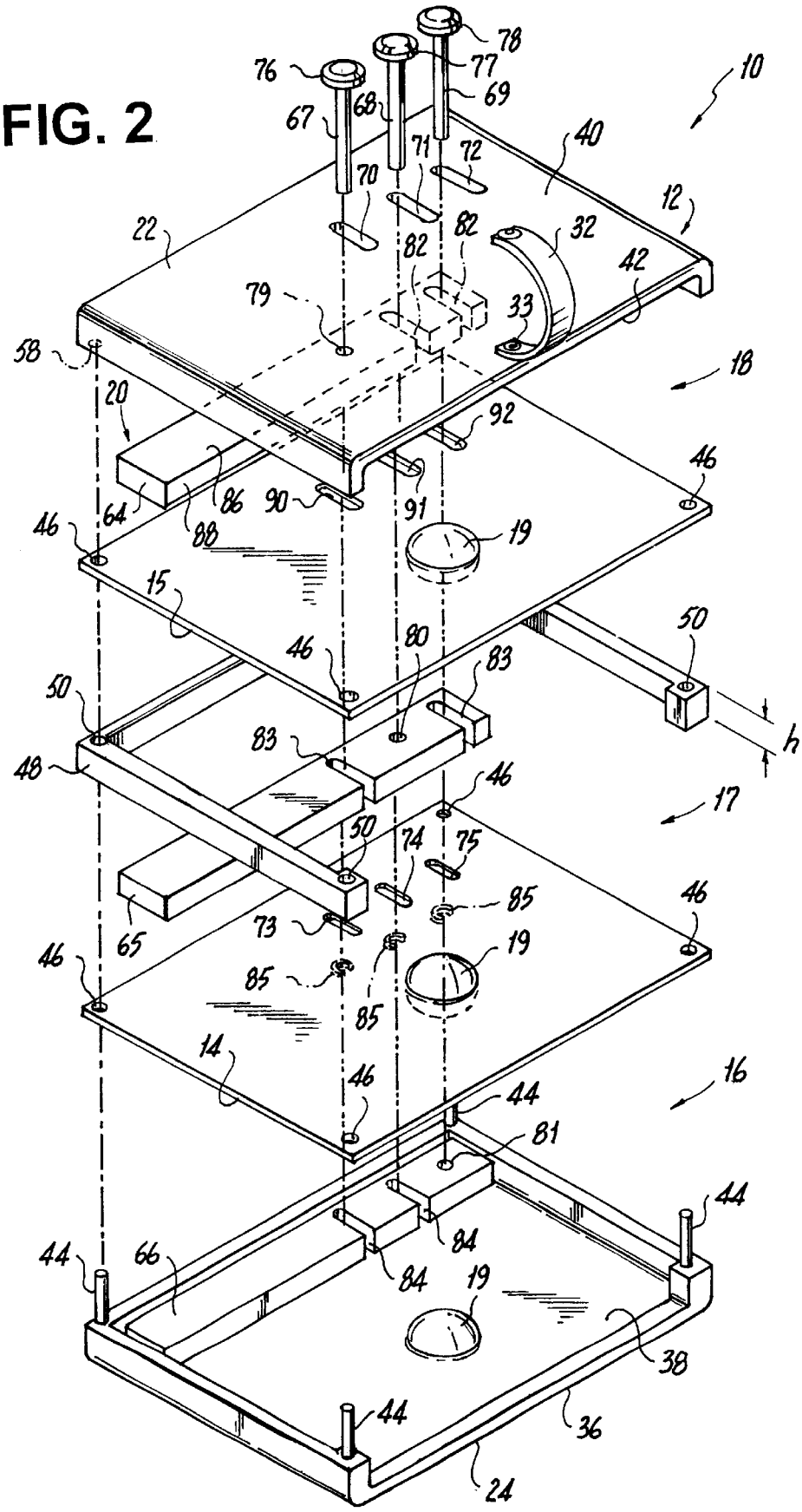
FIG. 2 is an exploded perspective of the preferred embodiment of the holding device of the present invention.

Referring to FIG. 2, a bottom cover 36 can be seen which has several pegs 44 extending orthogonally therefrom to receive separating walls 14 and 15 via apertures 46. The bottom cover 36 can also be provided with a recess 38 sized to accommodate an object such as a credit card. The bottom cover 36 is also sized for housing part of ejection mechanism 20. Separating wall 14 cooperates with recess 38 to form a chamber 16.

Additional chamber 17 is formed by using a spacer 48 which is placed between separating walls 14 and 15. The spacer 48 is shown with an outside perimeter which follows the outer contour of the housing 12 to form a portion of the sidewalls. The spacer 48 is preferably of a one piece design and made of a rigid plastic material. The spacer 48 has apertures 50 which receive the pegs 44 extending from the bottom cover 36 and are sized to secure the spacer 48 in place. The spacer 48 has a height, h, which is greater than objects placed within chamber 17 and greater than push plate 65.

Chamber 18 is formed by separating wall 15 and top cover 40, which is a mirror image of the bottom cover 36 with a recess 42 to allow an object to fit between the top cover 40 and separating wall 15. The top cover 40 can be provided with a plurality of peg holes 58 for receipt of pegs 44. An adhesive or plastic glue can be used to join the pegs 44 to the peg holes 58. The top cover 40, bottom cover 36, spacer 48, and separating walls 14 and 15 form the side walls 26, 28 and 30 of the outer housing 12.

The holding device 10 also has a safety strap 32 which attaches to the top cover 40, e.g., by using a screw 33, or can be integrally molded to the top cover 40 and extends over opening 34; and can be releasably securable to the bottom cover 36. The safety strap 32 is used to prevent cards from being inadvertently ejected by accidental actuation of a push rod.

One advantage of the design is that a card holding device having six or more chambers can be easily accomplished by assembling more spacers and separating walls to each other. (See FIG. 6).

Referring again to FIG. 2, each of the separating walls 14 and 15 has a biasing member 19 provided on at least one surface of each wall. In the embodiment as shown in FIG. 2, the biasing member 19 is a raised portion integrally formed on the separating wall 14 and 15 and top cover 40 and bottom cover 36. The biasing member 19 is preferably positioned so that when an object is placed within any of the chambers 16, 17 or 18 the biasing member 19 will exert a biasing force against the object to hold it securely against either separating wall 14 or 15 or top cover 40 or bottom cover 36. The biasing member 19 can be made of the same material as separating walls 14 and 15, which can be an injection molded plastic or metal.

Referring to FIG. 2, the ejection mechanism 20 will now be described in detail. The ejection mechanism 20 includes push plates 64, 65, 66 which slidably move within the chambers 16, 17 and 18 and are positioned so that they are substantially coplanar with the objects, such as a cards, positioned within chambers 16, 17 and 18. The push plates 64, 65 and 66 are urged to move within the chambers 16, 17 and 18 by push rods 67, 68, 69. The push rods 67, 68, 69 extend substantially perpendicular from the top surface of push plates 64, 65, 66. Push rods 67, 68, 69 slide within grooves 70, 71 and 72 in the top wall 40. Furthermore, separating wall 14 grooves 73, 74 and 75 and separating wall 15 grooves 90, 91 and 92 limit the movement of push rods 67, 68, 69. Push rods 67, 68, 69 can be provided with actuation buttons 76, 77 and 78 attached to the end of the push rods 67, 68, 69 exterior the housing 12.

Push plate 64 has two notches 82 which are spaced to permit push rods 68 and 69 to be moved without actuating push plate 64. Push rod 67 passes through separating wall grooves 73 and 90 and is secured to push plate 64 by insertion into aperture 79. Consequently, push rod 67 does not activate push plates 65 and 66. Push rod 67 can then be secured against longitudinal movement using a C-clip 85 or other similar device. Push rods 68 and 69 are similarly attached to their respective push plates 65 and 66.

Referring again to FIG. 2, push plates 64, 65 and 66 are all similarly configured. However, for exemplary purposes push plate 64 will be described in detail. In the preferred embodiment, push plate 64 has a contact surface 88 and a push plate top surface 86. The notches 82 extend through push plate 64 from top to bottom and open toward contact surface 88. Push plates 65 and 66 for chambers 16 and 17 are similarly configured as push plate 64 except that notches 83 and 84 and apertures 80 and 81 for push plates 65 and 66, respectively, are configured appropriately for chambers 17 and 16. Push rods 67, 68 and 69 are preferably positioned so that they are aligned with each other to create a clean aesthetic appearance.

Figure 7:
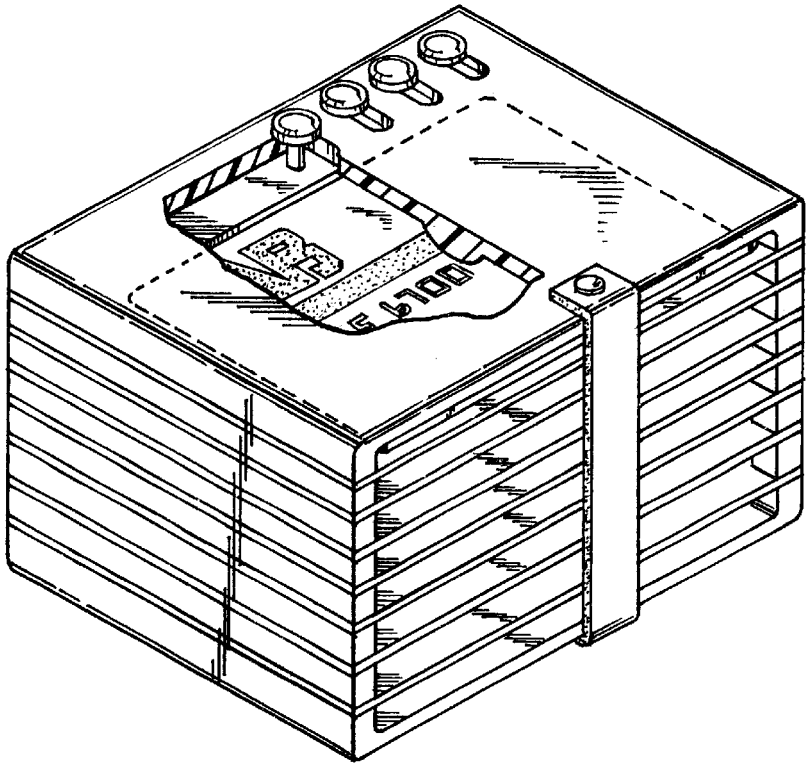
FIG. 7 is a perspective view of the preferred embodiment of the present invention with a partial cut away showing an object in the device having eight chambers.
Figure 8:
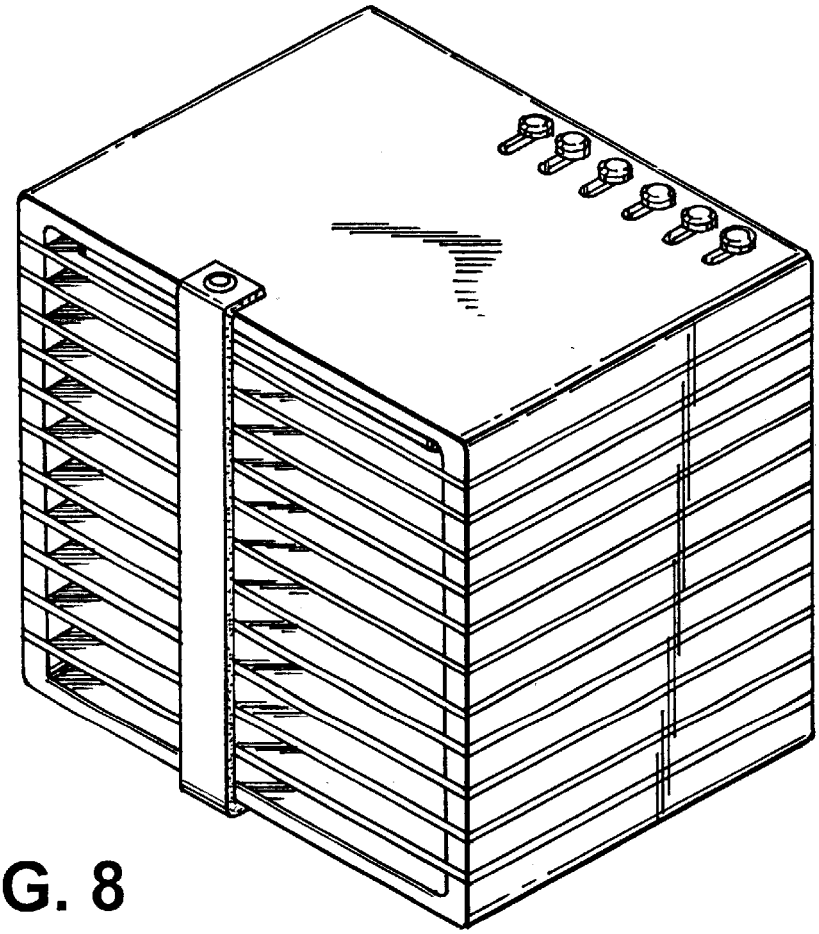
FIG. 8 is a perspective view preferred embodiment of the holding device having twelve chambers.

As stated earlier, it is envisioned that an eight card carrying device (FIG. 7) or twelve card carrying device (FIG. 8) can also be made. For exemplary purposes, the actuation of the three card holding device will be described in more detail.

Figure 3:
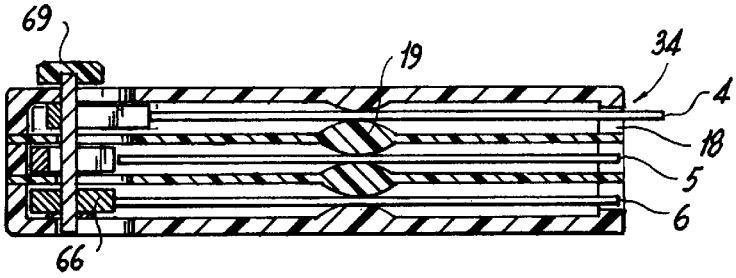
FIG. 3 is a cross sectional view of the preferred embodiment of the holding device of the present invention taken along line 3—3 of FIG. 1.
Figure 4:
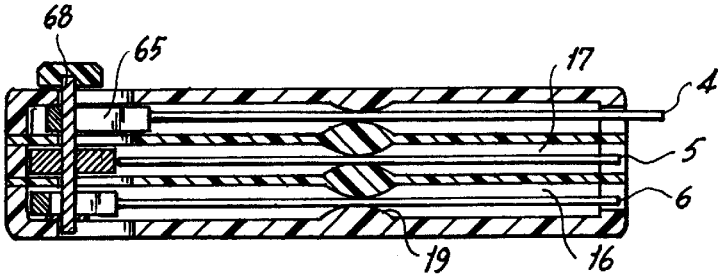
FIG. 4 is a cross sectional view of the preferred embodiment of the holding device of the present invention taken along line 4—4 of FIG. 1.
Figure 5:
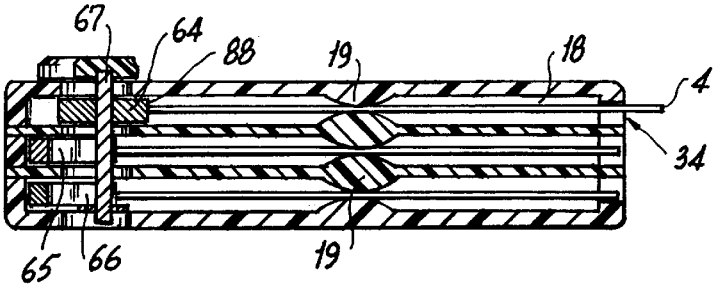
FIG. 5 is a cross sectional view of the preferred embodiment of the holding device of the present invention taken along line 5—5 of FIG. 1.

Referring to FIGS. 3, 4 and 5, during operation, a user inserts a card 4 into chamber 18 where it will be held in placed by biasing member 19, which urges the card against the opposite wall of chamber 18. Push plate 64 is positioned at the rear of the chamber 18 when not being actuated. When the card is to be removed, the user actuates push rod 67 to urge push plate 64 towards the opening 34 of the object holding device 10. The card in chamber 18 is pushed by the contact surface 88 of push plate 64 which comes into contact with the edge of the card and urges the card out of the object holding device 10 as shown in cross section FIG. 3. Cards 5 and 6 positioned in the chamber 17 and chamber 16 are not moved.

Figure 6:
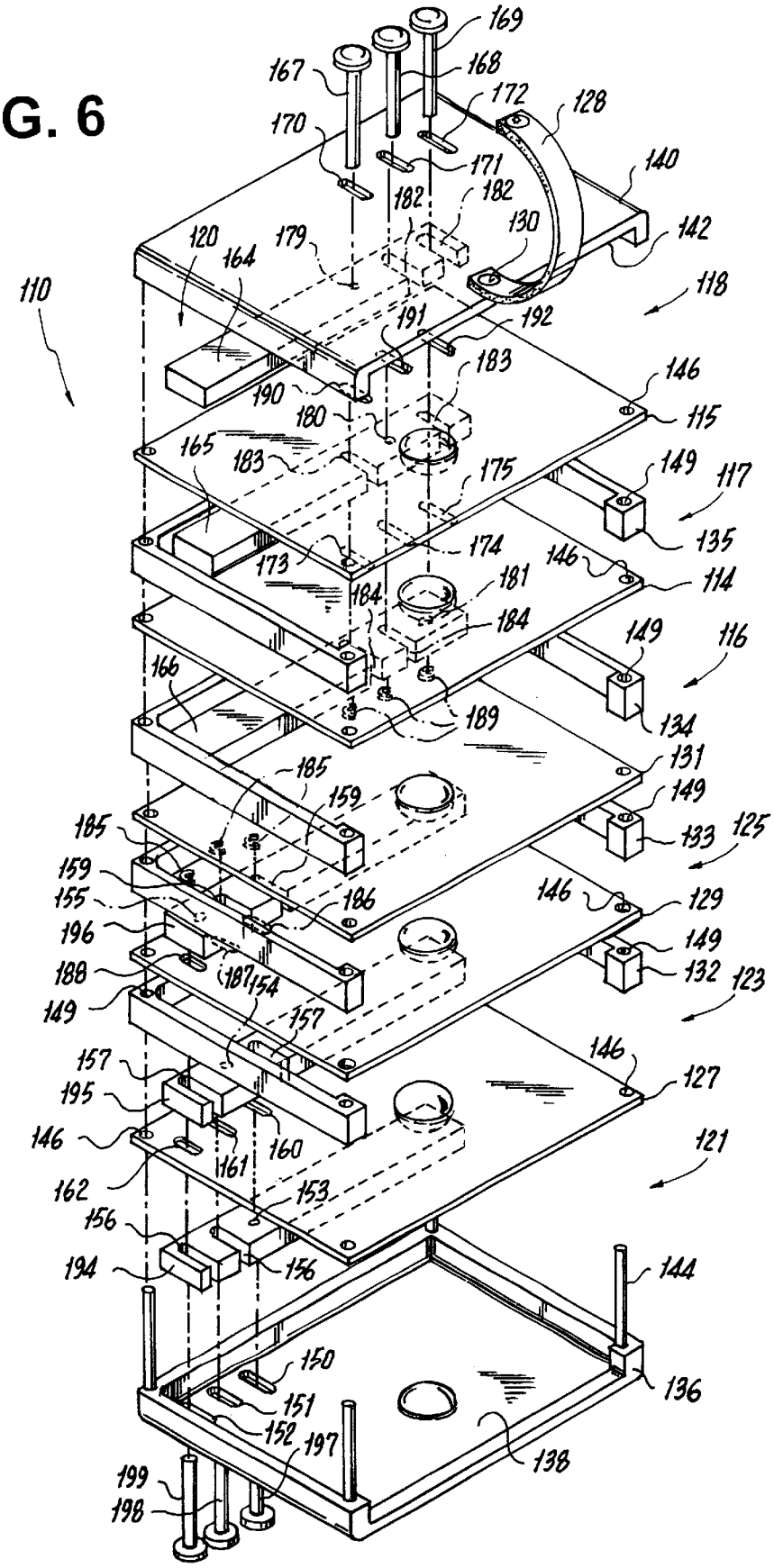
FIG. 6 is an exploded perspective view of the preferred embodiment of the holding device having six chambers.

Referring to FIG. 6, a six chamber holding device 110 is shown. The holding device 110 is similarly constructed to the first embodiment. The card holding device has a bottom cover 136 having pegs 144 extending orthogonally therefrom to receive separating walls 127, 129, 131, 114 and 115 via apertures 146. A chamber 121 is formed by separating wall 127 and bottom cover 136 having a recess 138.

Additional chambers 123, 125, 116 and 117 are formed by alternately stacking spacers 132, 133, 134 and 135 with separating walls 129, 131, 114 and 115. Spacers 132, 133, 134 and 135 each have apertures 149 to receive pegs 144 to secure the spacers in place. A chamber 118 is formed by separating wall 115 and top cover 140 having a recess 142. Each chamber is sized to allow an object to be removably inserted and ejected from the chamber.

The ejection mechanism 120 is also similarly constructed to the first embodiment. The ejection mechanism 120 includes a first set of push rods 167, 168 and 169 which are attached to individual push plates 164, 165 and 166 by securement to apertures 179, 180 and 181, respectively. The ejection mechanism includes a second set of push rods 197, 198 and 199 which are attached to individual push plates 194, 195 and 196 by securement to apertures 153, 154 and 155, respectively.

Push rods 167, 168 and 169 pass through top cover grooves 170, 171 and 172, and separating wall 115 grooves 190, 191 and 192, and separating wall 114 grooves 173, 174 and 175 and are secured against longitudinal movement by C-clips 189. Push rods 197, 198 and 199 pass through bottom cover grooves 150, 151 and 152, and separating wall 127 grooves 160, 161 and 162, and separating wall 129 grooves 186, 187 and 188 and are secured against longitudinal movement by C-clips 185.

Each push plate is also provided with notches to permit actuation of nonattached push rods as follows: push plate 164 has notches 182; push plate 165 has notches 183; push plate 166 has notches 184; push plate 194 has notches 156; push plate 195 has notches 157; and push plate 196 has notches 159.

The holding device 110 also has a safety strap 128 which attaches to the top cover 140, e.g., by using a screw 130, or can be integrally molded to the top cover 140 and extends over opening 134; and can be releasably securable to the bottom cover 136. The safety strap 128 is used to prevent cards from being inadvertently ejected by accidental actuation of a push rod.

Figure 9:
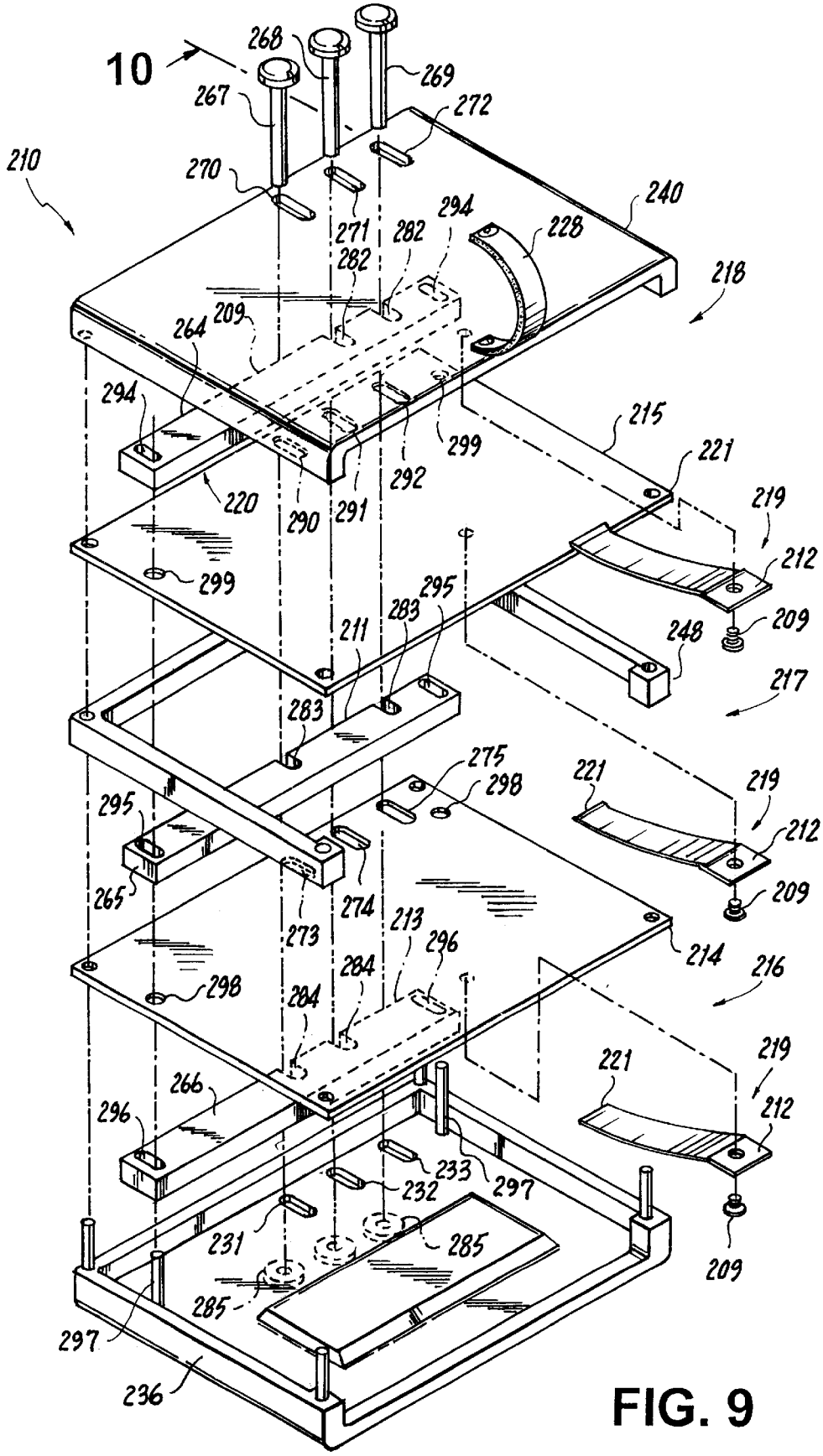
FIG. 9 is an exploded perspective of an alternative embodiment of the holding device of the present invention.

A third embodiment of the present invention is shown in FIG. 9. A top cover 240, separating walls 214 and 215 and spacer 248 can be provided in a manner and construction similar to the embodiment shown in FIG. 1. A safety strap 228 can be provided in a manner and construction similar to the embodiment shown in FIG. 6. And ejection mechanism 220 is constructed and actuates as described below.

Referring to FIG. 9, push rods 267, 268 and 269 extend through top cover grooves 270, 271 and 272, and separating wall 215 grooves 290, 291 and 292 and separating wall 214 grooves 273, 274 and 275 and bottom cover grooves 231, 232 and 233 and are secured against longitudinal movement using C-clips 285 or other similar device. Furthermore, each push rod is aligned behind the push plates 264, 265 and 266.

Figure 10:
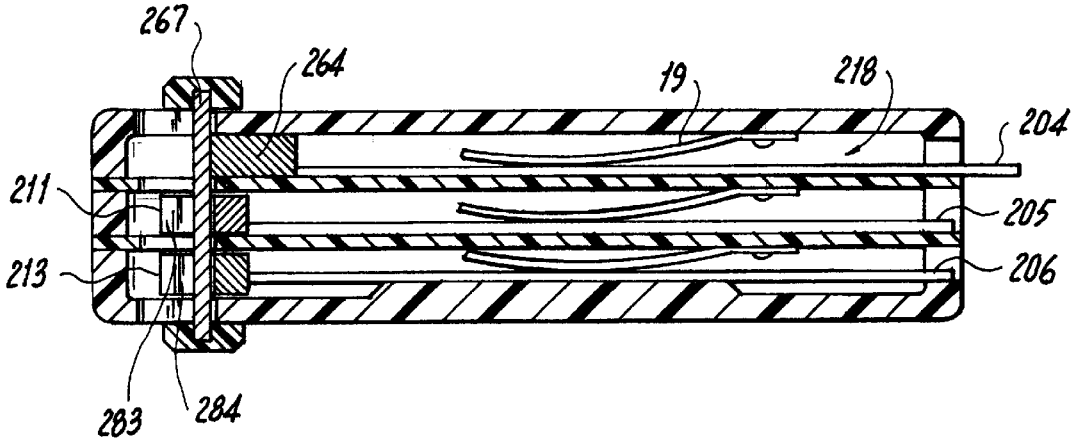
FIG. 10 is a cross sectional view of the alternative embodiment of the holding device taken along line 10—10 of FIG. 9.

Referring to FIGS. 9 and 10, push rod 267 actuates push plate 264 by engagement with edge 209 while passing freely through push plate 265 via notches 283 and push plate 266 via notches 284. Push plate 264 has notches 282 to allow push rods 268 and 269 to pass freely through when they are actuated. Push plates 265 and 266 have edges 211 and 213, respectively, which engage push rods 268 and 269 when actuated. FIG. 10 shows that push plates 265 and 266 are not actuated and that cards 205 and 206 will not be ejected when push rod 267 is actuated.

Push plates 264, 265 and 266 are each guided in place by guide rods 297. Guide rods 297 extend orthogonally from the bottom cover 236 and pass through separating wall apertures 298 and 299 and each push plate 264, 265 and 266 through push plate guide rod grooves 294, 295 and 296, respectively. The guide rod grooves 294, 295 and 296 are sized to allow push plates 264, 265 and 266 to slidably move when desired.

Referring to FIG. 9, leaf springs 219 operate as biasing members and each is attached to separating walls 214 and 215 and top cover 240 with screws 209 or similar fastening device. Each spring 219 is preferably rectangular in shape and has an attachment end 212 attached to one wall of each of the chambers 216, 217 and 218, and a free end 221 extending towards the opposite wall of each chamber, whereby a biasing tension is exerted against an object placed in the chamber.

Figure 11:
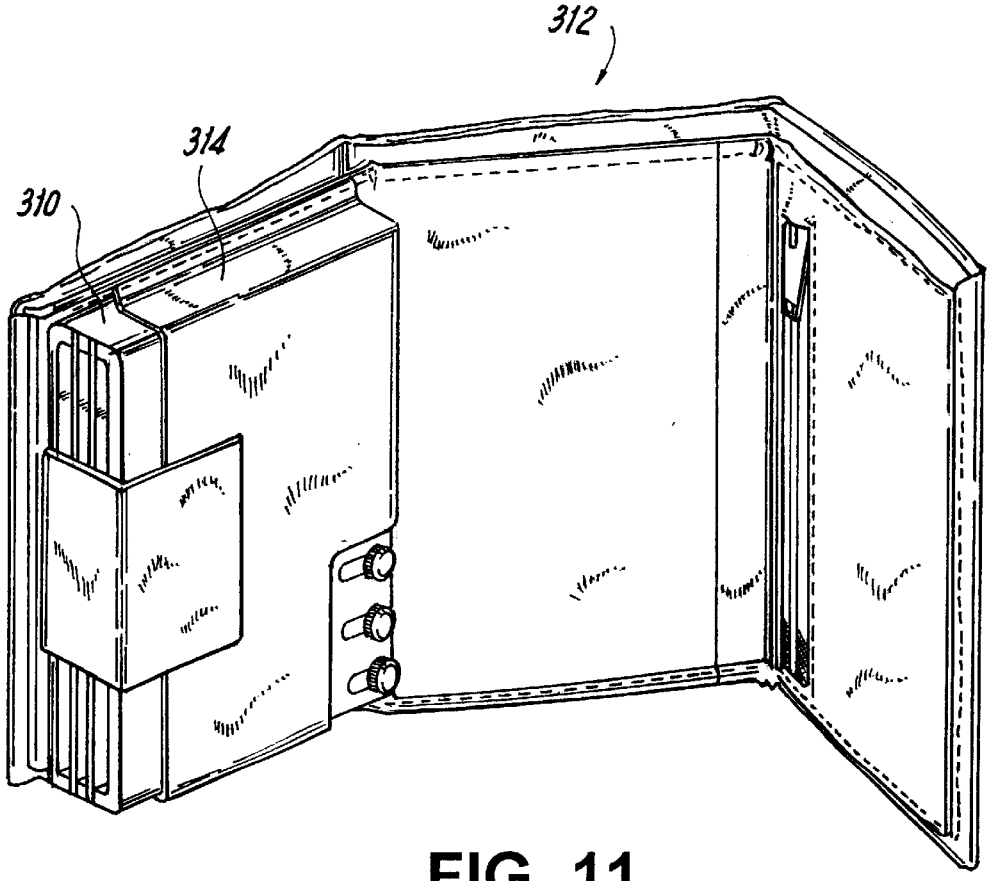
FIG. 11 is a perspective view of the preferred embodiment of the holding device incorporated into a wallet.

The object holding device can be incorporated into present carrying devices such as a wallet, billfold or brief case. Referring to FIG. 11, an object holding device 310 is incorporated into a wallet 312. The wallet 312 has an object holding pouch 314 which allows the object holding device 310 to be either removably inserted into the pouch 314 or permanently attached to the wallet 312. The holding pouch 314 can be sized to accommodate a six or eight card object holding device.

Figure 12:
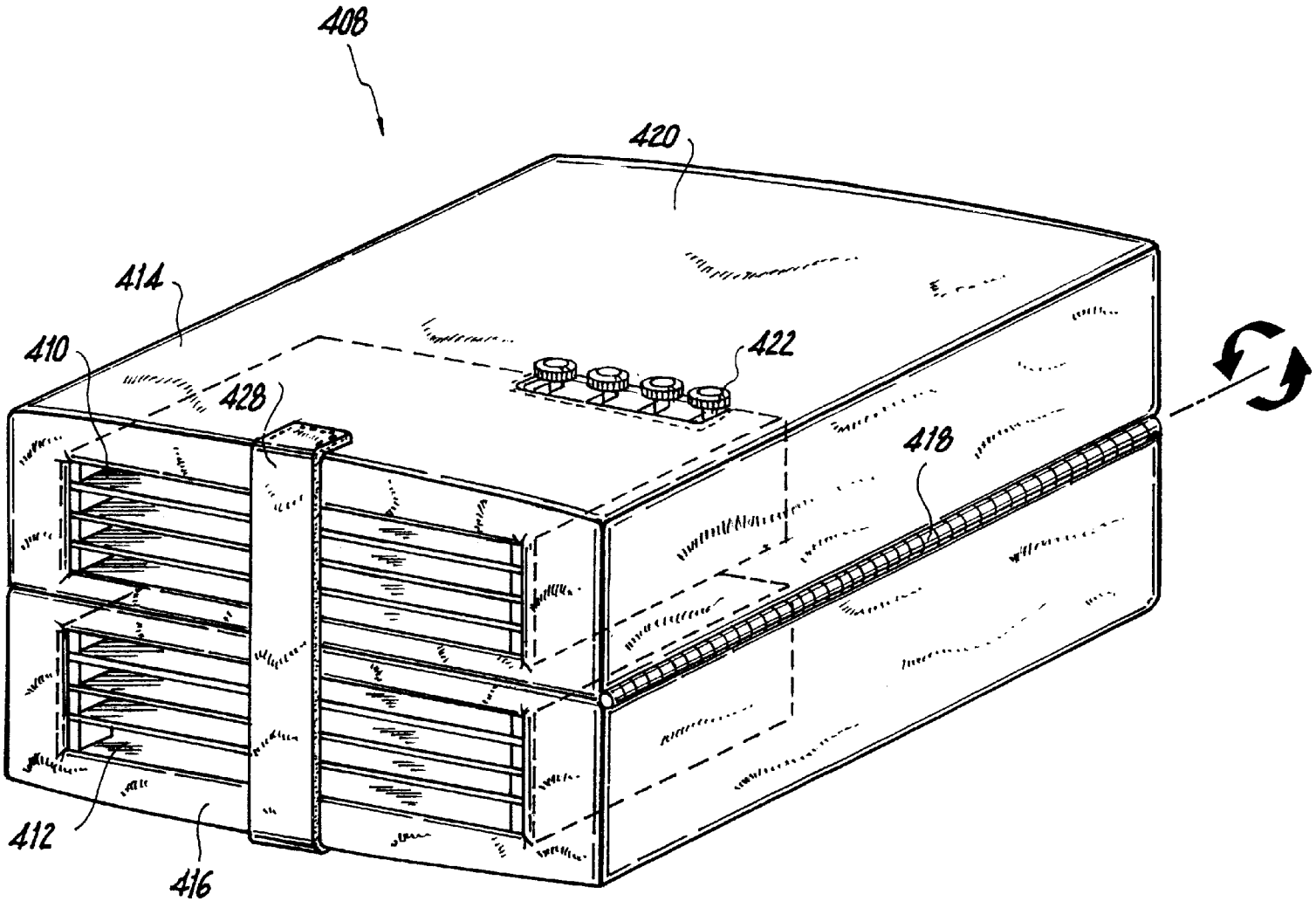
FIG. 12 is a perspective view of the object holding device of the present invention in a personal organizer.

FIG. 12 shows a personal organizer 408 having two object holding devices 410 and 412 contained therein. The object holding devices 410 and 412 can be placed in a first part 414 and a second part 416 of the personal organizer 408 connected by a hinge 418. A safety strap 428 is used that extends from the first part 414 to the second part 416 to prevent inadvertent ejection of cards out of the object holding devices 410 and 412. The personal organizer 408 can have a decorative outer covering 420 made of leather, vinyl or other material that is aesthetically pleasing to the user. It is envisioned that any number of outer coverings 420 or buttons 422 can be used according to the desires and needs of the particular user.

An advantage of the present invention is that it can be easily incorporated into present carrying devices such as wallets, bill folds and other personal organizers to increase the storage capacity and organization of the item.

Therefore, while there have been described what are presently believed to be preferred embodiments of the present invention, those skilled in the art will realize that other and further changes and modifications can be made thereto without departing from the scope of the invention, and it is intended to claim all such changes and modifications as fall within the scope of the invention.

What is claimed is:

1. A personal object holding device comprising:

an outer housing having a plurality of separating walls positioned therein, said walls forming a plurality of card holding chambers sized to accommodate an object approximating the size of a credit card;

at least one biasing member positioned on one of said separating walls for each chamber wherein said biasing member creates a biasing tension against an object positioned in said chamber to hold said object in place; and an ejection mechanism positioned in said housing to urge said object from each said chamber, said ejection mechanism including at least one push plate slidably positioned within said each chamber, said plate aligned so as to be substantially co-planar with a card positioned within said chamber, and at least one push element slidably extending from a top surface of the housing to bottom surface of the housing, said push element slidable within a groove in said housing, whereby said push element is moved to contact said push plate to push the card out of said chamber.

2. A card holder as defined in claim 1, further including an actuation button attached to an end of said push element exterior said housing.

3. A card holder as defined in claim 1, wherein said push plate further includes a push rod contact area so that said at least one push rod will engage said push plate.

4. A card holder as defined in claim 2, wherein said at least one push rod engages said push plate to eject only one card.

5. A card holder as defined in claim 2, wherein said biasing member is a resilient piece of metal attached to one of said separating walls of said chamber and extending toward an opposed wall of said chamber.

6. A card holder as defined in claim 5, wherein said biasing member extends from one edge of a separating wall of said chamber to an edge of said separating wall opposite said one edge.

7. A card holder as defined in claim 4, wherein said biasing member is integrally formed as a part of said separating wall of said chamber.

8. A card holder as defined in claim 7, wherein said card holder further includes a second push plate positioned in a second card holding chamber positioned below said first card holding chamber, said second push plate having a corresponding second push rod for engaging said second push plate.

9. A card holder as defined in claim 8, wherein said push plate further includes a plurality of notches positioned therein and said second push rod is positioned in said notch when said second push plate is engaged.

10. A card holder comprising:

an outer housing having a plurality of separating walls positioned therein, said walls forming a plurality of card holding chambers that are sized to accommodate a card the size of a credit card;

at least one biasing member positioned on one of the separating walls for each chamber, said biasing member extending from a first separating wall of said chamber to an adjacent second separating wall of said chamber, wherein said biasing member creates a biasing tension against a card positioned in said chamber to hold the card in place;

an ejection mechanism having at least one push plate slidably positioned within said each chamber and aligned co-planar with a card positioned within said chamber;

at least one push element attached to said push plate extending from a top surface of said push plate and through the top of said housing, said push element sliding within a groove in said housing, whereby said push rod can be slidably moved in said groove to move said push plate to push the card out of said chamber; and an actuation button attached to an end of said at least one push element exterior said housing.

* * * * *

UNITED STATES PATENT AND TRADEMARK OFFICE

CERTIFICATE OF CORRECTION

PATENT NO. : 6,581,762 B2
DATED : June 24, 2003
INVENTOR(S) : Robert Keough

It is certified that error appears in the above-identified patent and that said Letters Patent is hereby corrected as shown below:

Column 1,
Line 36, now reads " "messy,")" should read -- "messy," --

Column 8,
Line 3, now reads "in claim 2," should read -- in claim 1, --

Signed and Sealed this

Thirtieth Day of September, 2003

JAMES E. ROGAN
*Director of the United States Patent and Trademark Office*